United States Patent [19]

Haaf et al.

[11] Patent Number: 4,676,873

[45] Date of Patent: Jun. 30, 1987

[54] COKE OVEN DOOR

[75] Inventors: Friedhelm Haaf, Velbert, Fed. Rep. of Germany; Mutien-Marie Renverse, Tornai, Belgium

[73] Assignee: Krupp Polysius AG, Beckum, Fed. Rep. of Germany

[21] Appl. No.: 771,600

[22] Filed: Sep. 3, 1985

[30] Foreign Application Priority Data

Sep. 28, 1984 [DE] Fed. Rep. of Germany ..... 3435758

[51] Int. Cl.[4] ..... C10B 25/06

[52] U.S. Cl. ..... 202/242; 202/248

[58] Field of Search ..... 202/248, 268, 269, 245, 202/242, 246; 201/40; 110/173 R; 122/498; 126/191, 198; 49/485

[56] References Cited

U.S. PATENT DOCUMENTS

| | | | |
|---|---|---|---|
| 2,238,239 | 4/1941 | Wilputte | 202/248 |
| 2,251,541 | 8/1941 | Grasshoff | 202/248 |
| 2,338,675 | 1/1944 | Ackeren | 202/248 |
| 2,442,391 | 6/1948 | Wilputte | 202/248 |
| 2,780,590 | 2/1957 | Doll | 202/248 |
| 3,705,087 | 12/1972 | Grumm et al. | 202/248 |
| 3,933,598 | 1/1976 | Pries | 202/248 |
| 4,427,494 | 1/1984 | Naevestad | 202/248 |

*Primary Examiner*—Barry S. Richman
*Assistant Examiner*—Joye L. Woodard
*Attorney, Agent, or Firm*—Learman & McCulloch

[57] ABSTRACT

A coke oven door having a door body, a door stop support connected to the door body and a levelling closure for closing a levelling opening in the door body. To compensate for differing deformations, particularly in the region of the levelling closure and the door body, the levelling closure is constructed as a separate levelling box fixed on the door stop support and is connected to the door body by an adjustable slidably movable connection.

5 Claims, 3 Drawing Figures

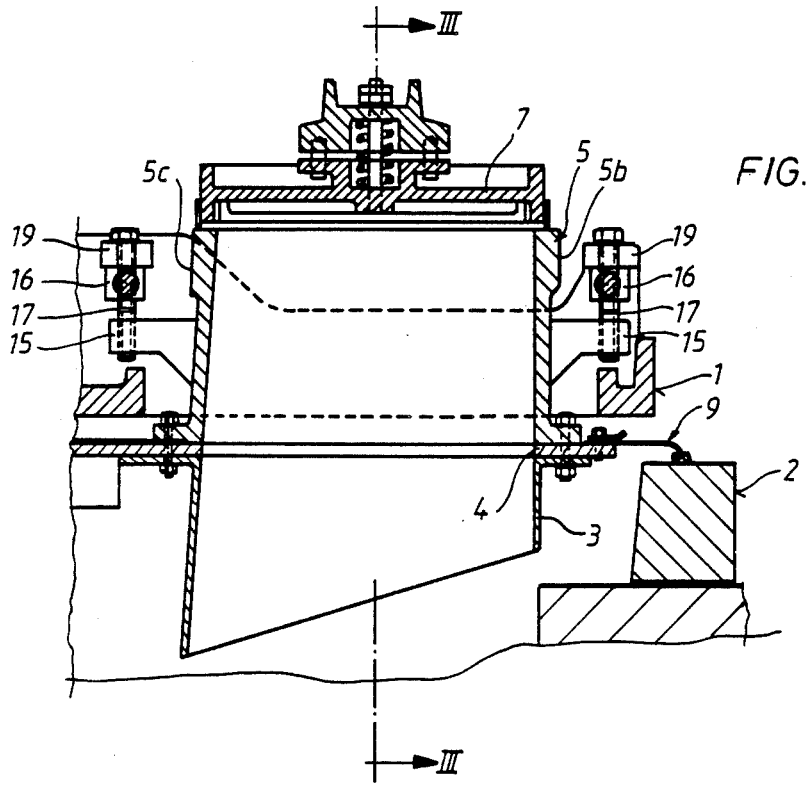
FIG. 1
FIG. 2
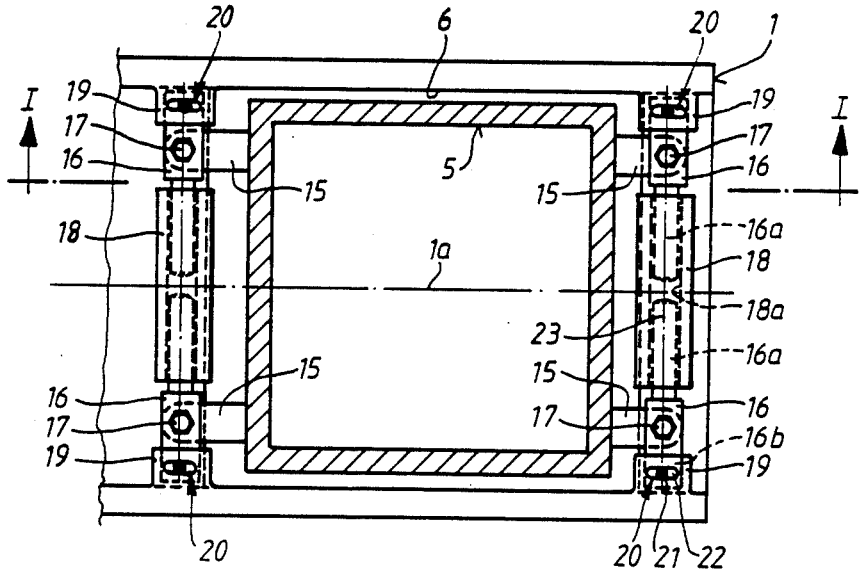

COKE OVEN DOOR

BACKGROUND OF THE INVENTION

A coke oven door of the general type to which the invention relates is described in U.S. patent application Ser. No. 664,699. In this earlier version, which deals in particular with the construction of a sealing element for sealing the gap between the door stop support and the door frame, levelling openings which face one another can be provided in the door body, in the door stop support and in the door stop, and the levelling opening in the door body can be closed with the aid of a levelling closure. In addition, the door stop support (and with it the door stop itself) is preferably connected with the aid of an elastic compensator to the door body, and a protective pipe which can be arranged so as to be fixed in the levelling opening of the door body and slidably movable in the levelling openings of the door stop carrier and the door stop is arranged on the inner surface of the compensator.

In this earlier coke oven door body forms a supporting assembly with locking arrangements, adjustment elements, etc., whilst a second assembly contains the door stop support and the door stop, both assemblies being adjustably connected to each other by adjustment means in order to be able to compensate for differing deformations and fulfil the sealing functions better.

The object of the invention is to make further improvements to a coke oven door of the type referred to in such a way that a particularly reliable adjustment facility is provided above all on the so-called pusher side in the arrangement of a levelling opening, whilst at the same time providing a reliable sealing effect, relatively simple construction and accessibility.

SUMMARY OF THE INVENTION

In the coke oven door according to the earlier invention, the levelling closure constructed in the form of a levelling box is arranged fixed on the door stop support and it is also firmly connected to the assembly containing the sealing element. By contrast this levelling closure is connected for movement relative to the door body by means of an adjustable slidably movable connecting arrangement. In this way the levelling closure has an independent adjustment facility relative to the door body so that it is able to compensate in different directions for changes which may occur, for example as a result of mechanical or thermal effects. Because the door body and the levelling closure are adjustable and slidably movable relative to one another it is also possible at the same time to compensate for the differential deformations between the assembly with the door body and the assembly with the sealing element, the door stop support and the door stop in the region of the levelling openings in the required manner and by relatively simple constructional means.

THE DRAWINGS

Advantageous embodiments and further features of the invention are explained in greater detail with reference to the accompanying drawings wherein:

FIG. 1 shows a partial longitudinal section through a coke oven door in the region of a levelling opening (in a section along the line I—I in FIG. 2);

FIG. 2 shows a partially cutaway plan view of the part of the coke oven door shown in FIG. 1;

DETAILED DESCRIPTION

Figure 3:
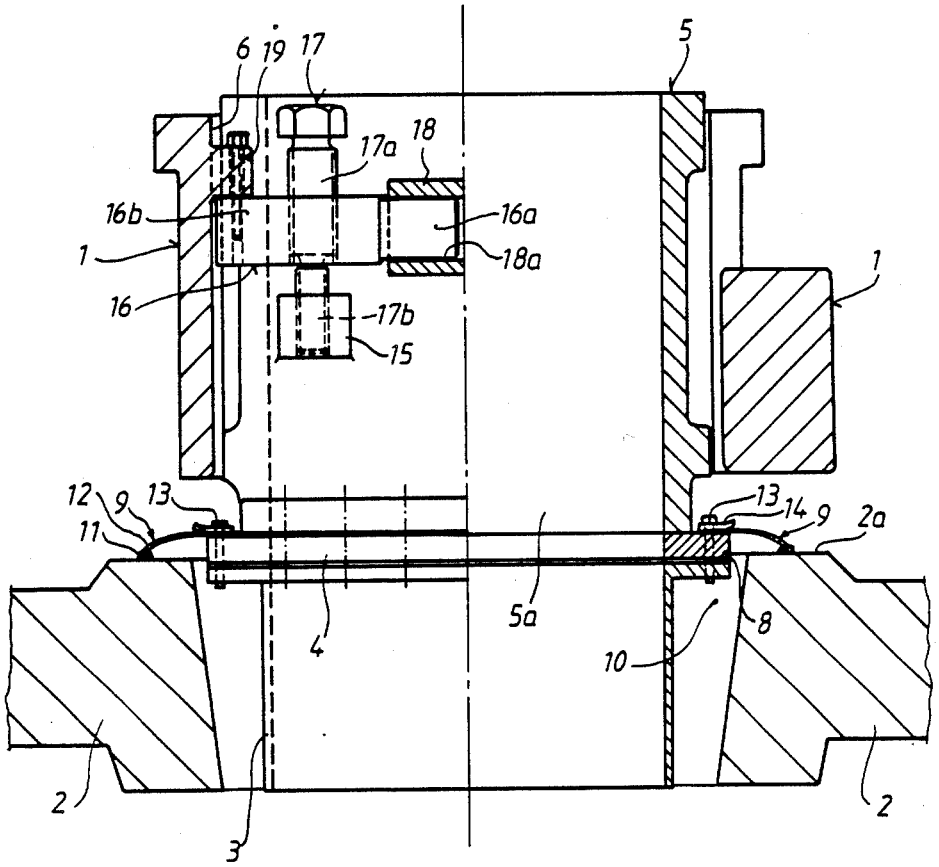
FIG. 3 shows a partial cross-sectional view (without levelling door) corresponding approximately to the line III—III in FIG. 1, in which the levelling box is shown partly in elevation and partly in section.

For the sake of simplicity, only those parts of the coke oven door which are regarded as necessary for the explanation of the invention are shown in the drawings.

The coke oven door comprises a door body 1 which can be clamped and locked relative to a stationary door frame 2 with the aid of arrangements which are not shown in greater detail because they are known.

A door stop 3 is supported by a door stop support 4 which is connected by a levelling closure casing in the form of a box 5 and a connection arrangement, which will be explained below, to the door body 1. This levelling closure serves to close a levelling opening 6 provided in the door body 1. The levelling closure casing 5 can be closed, at its upper end in the drawing, by a levelling door 7 in a manner which is known per se and is therefore not illustrated in greater detail.

The levelling closure casing is constructed in the form of a separate levelling box 5 and is fixed at its end 5*a*, which is at the opposite end from the levelling door, on the door stop support 4. For this purpose a flange connection 8 by means of which the levelling box 5 and the door stop support 4 are releasably fixed to one another, preferably by means of screws, can be provided between the said end 5*a* of the levelling box 5 and the door stop support 4.

A sealing element 9, which runs around the whole periphery of the coke oven door and is rounded at the corners, serves to seal the gap 10 between the door stop support 4 and the door frame 2. It is preferably mounted on the flange connection 8. This sealing element 9 consists essentially of a metal sealing strip 11 which comes to rest on the door frame 2 and a resilient metal diaphragm 12 which is preferably lid-shaped. This diaphragm 12 is clamped at its inner edge on the door stop support 4 by means of screws 13 and carries the aforesaid sealing strip 11 on its outer edge. The sealing strip 11 and the diaphragm 12 are advantageously constructed in one piece.

By means of the diaphragm, which is curved like a lid, the sealing strip 11 can, when it is pressed on the door frame 2, form a wedge-shaped gap which opens towards the exterior and through which the tarry residues present on the surface 2*a* of the door frame 2 can be introduced into a groove in the sealing strip 11. The tarry material which is automatically taken up in this way by the sealing strip 11 forms a reliable seal of the gap between the door stop support 4 and the door frame 2 immediately after the sealing strip 11 has been pressed onto the door frame 2 upon clamping and locking of the coke oven door.

In order to limit the resilient deflection of the diaphragm 12, a rigid stop 14 is advantageously clamped together with the diaphragm 12 on the door stop support 4. This stop 14 covers a part of the diaphragm 12 so that the outer part of the diaphragm 12 can only be deformed to a limited extent. Thus the door stop 3, the door stop support 4, the sealing element 9 and the levelling box 5 are firmly connected to each other to form one assembly.

As distinct from the aforementioned assembly, the door body 1 forms with its clamping and locking arrangements a further assembly which is adjustable relative to the first assembly. The part of the door body 1 containing the levelling opening 6, as illustrated in the drawing, is constructed as a frame.

As already indicated above, an adjustable slidably movable connecting arrangement is provided between the door body 1 and the levelling box 5. This connecting arrangement is described below.

Basically this connecting arrangement comprises projections 15 which are mounted, preferably constructed integrally, on opposing side surfaces 5*b* and 5*c* of the levelling box 5, retaining pieces 16 which are borne by the door body 1 and supported so as to be slidably movable, and adjustment spindles 17 which connect the projections 15 and the retaining pieces 16 adjustably together. The said retaining pieces 16 are arranged in pairs spaced from each other on each of the frame sides of the door body 1 which lie opposite the side surfaces 5*b* and 5*c* of the levelling box which include the projections 15. In each case one retaining piece 16 is arranged above an associated projection 15 of the levelling box 5, preferably near to one corner of the levelling box 5, which is rectangular in ground plan (cf. FIG. 2). The two retaining pieces 16 located on one frame side of the door body 1 are aligned relative to each other. At their ends which are opposite one another each has cylindrical guide pin 16*a*. The guide pins 16*a* of a pair of retaining pieces which belong together are inserted, with a sliding fit, into a suitable bore 18*a* in a connecting sleeve 18 with their ends spaced from one another and guided slidably therein. In this way the retaining pieces 16 or pairs of retaining pieces can relatively slide to compensate for changes occurring along the longitudinal direction of the connecting sleeve 18.

Each retaining piece 16 is mounted with its end which lies opposite the guide pin 16*a* on a retaining projection 19 which protrudes inwards. This mounting is by means of a screw-slot connection 20. Each such screw-slot connection 20 can contain at least one fixing screw 21 which passes through a slot 22 and is screwed into the retaining piece 16 lying below it. This slot 22 lies in each case at right angles to the common longitudinal axis 23 of a pair of retaining pieces and the associated connecting sleeve 18. Thus, by means of this screw-slot connection 20, the retaining pieces 16 can be adjusted or repositioned together with the levelling box 5 or the relevant part thereof in the direction of the longitudinal axis 1*a* of the door body 1.

A further possibility for adjustment of the levelling box 5, and thus the door stop support 4, relative to the retaining pieces 16 and thus to the door body 1 is provided by the adjustment spindles 17. These adjustment spindles 17 have on their length two adjoining threaded sections 17*a* and 17*b* which have different thread pitches. The first threaded section 17*a* is screwed into the associated retaining piece 16, whilst the second threaded section 17*b* is in screwed connection with the associated projection 15 on the levelling box 5 lying below this retaining piece 16. This interconnection can be seen particularly clearly from FIG. 3. If in this arrangement an adjustment spindle is turned, for example with the aid of a screw spanner, then it carries out a longitudinal movement in the associated retaining piece 16. Because of the differing thread pitches of the threaded sections 17*a* and 17*b*, the associated projection 15 and thus the levelling box 5, with the parts mounted thereon, move a shorter distance because of the smaller thread pitch on the section 17*b*. A very delicate adjustment in the depth of the levelling box 5 and all the parts connected thereto relative to the door body 1 can thus be achieved.

It should be mentioned at this point that on the part of the door body 1 in which no levelling closure is provided, the door stop support 4 with the door stop 3 and the sealing element 9 can be connected directly by means of adjustment spindles of the aforesaid type as is also described in the earlier Patent Application No. referred to above.

What is claimed is:

1. In a coke oven door for closing a vertically extending opening in a coke oven comprising:

(a) an upright door body having a longitudinal axis and a levelling opening therein, (b) a door stop support which supports a door stop and is connected to the door body, and (c) a levelling closure casing disposed in said levelling opening forming a passageway therethrough for a leveller bar, and a levelling door for closing the passageway, the improvement wherein:

(d) the levelling closure casing is in the form of a separate levelling box fixed to the door stop support, and including (e) adjustable connecting means connecting the door body and the levelling box for adjustment of their relative positions, (f) said connecting means comprising a first adjustable support for adjusting the depth of said levelling box relative to said door body, and a second adjustable support for adjusting the vertical position of said box relative to the upright door body.

2. Coke oven door as claimed in claim 1 wherein said levelling opening in the door body is formed as a frame, and said first adjustable support comprises projections mounted on opposing side surfaces of the levelling box that extend perpendicular to the longitudinal axis of the body, retaining pieces connected to the frame sides of the door body that extend parallel to the longitudinal axis of the door body, and adjustment spindles connecting said projections and the retaining pieces, whereby the depth of said box is adjustable relative to said door body.

3. Coke oven door as claimed in claim 2 wherein said retaining pieces includes two retaining members arranged as a pair having opposing ends spaced from each other, each retaining member of each pair including a guide pin extending towards an opposing guide pin, and a coaxial connecting sleeve slideably guiding and joining the guide pins of each pair along a common longitudinal axis whereby the retaining members of each pair can slide relative to each other to compensate for thermal or mechanical changes along the longitudinal axis of the connecting sleeve.

4. Coke oven door as claimed in claim 3 wherein the retaining members are connected to the frame sides of the door body by screws extending through retaining projections mounted on the door body, and said second adjustable support comprises a screw slot in said retaining projections extending at right angles to the common longitudinal axis of a pair of retaining members and the associated connecting sleeve, whereby the vertical position of the levelling box is adjustable relative to the upright door body within limits of the screw slots.

5. Coke oven door as claimed in claim 2 wherein said adjustment spindles have two threaded sections with different thread pitches, one of said threaded sections being in threaded engagement with the associated retaining piece, and the other threaded section being in threaded engagement with the associated projection on the levelling box.

* * * * *